US007299743B2

(12) United States Patent
Moore

(10) Patent No.: US 7,299,743 B2
(45) Date of Patent: Nov. 27, 2007

(54) AERATING DECANTER WITH DISPENSING VALVE

(76) Inventor: James R. Moore, 813 Russleo Dr., Nashville, TN (US) 37209

( * ) Notice: Subject to any disclaimer, the term of this patent is extended or adjusted under 35 U.S.C. 154(b) by 392 days.

(21) Appl. No.: 10/708,625

(22) Filed: Mar. 16, 2004

(65) Prior Publication Data

US 2005/0205609 A1 Sep. 22, 2005

(51) Int. Cl.
*B65B 39/00* (2006.01)

(52) U.S. Cl. ..... 99/323.1; 99/277.1; 99/277.2; 141/344; 141/331; 239/520

(58) Field of Classification Search ..... 99/323.1, 99/277.1, 277.2, 277, 275; 366/130; 141/344, 141/264, 331, 364; 261/112.1; 239/520
See application file for complete search history.

(56) References Cited

U.S. PATENT DOCUMENTS 87,745 A * 3/1869 Wolters ..... 141/94
740,847 A 10/1903 Glebsattel
1,179,892 A * 4/1916 Graham ..... 412/19
4,162,129 A 7/1979 Bartholomew, Jr.
4,494,452 A 1/1985 Barzso
4,785,724 A 11/1988 Vassallo
5,293,912 A 3/1994 Wildash et al.
5,595,104 A 1/1997 Delaplaine
5,713,263 A 2/1998 Burks, III
6,332,706 B1 12/2001 Hall
6,508,163 B1 1/2003 Weatherill

OTHER PUBLICATIONS

Exhibit A: "Austrian Hanging Wine Decanter", admitted to be prior art (at least as early as Dec. 31, 1959).

* cited by examiner

*Primary Examiner*—Reginald L. Alexander
(74) *Attorney, Agent, or Firm*—Waddey & Patterson, P.C.; Lucian Wayne Beavers

(57) ABSTRACT

This invention combines several processes into on easy to use product. The glass sphere dramatically enhances the aeration procedure by gently exposing air to thin waves of wine as wine passes over the surface of the sphere. The integrated filter provides a larger surface than normally found in wine filtration devices. The supporting structure secures the decanter in such a way that consumers can easily dispense wine without handling a wine bottle or conventional decanter.

19 Claims, 5 Drawing Sheets

SECTION A–A

AERATING DECANTER WITH DISPENSING VALVE

BACKGROUND OF INVENTION

At present there are a variety of methods a consumer can use to aerate wines. These processes range from manual to highly mechanized methods. Manually, wine is poured into a vessel, which exposes the wine to the air as it is transferred from the bottle. There are many artistic decanters on the market to accomplish this task ranging from pitchers to highly crafted crystal containers. Some specialty devices have been created to assist in aerating wine introduced into decanters which regulate the flow of wine into the decanter (U.S. Pat. No. 5,293,912). None of these vessels dispense wine from the vessel into their glass without pouring. Mechanically, there are apparatuses that; inject air into the wine bottle, (U.S. Pat. Nos. 4,494,452 4,785,724 5,595,104 6,508,163); transfer wine back and forth between decanters (U.S. Pat. No. 4,162,129); as well as swirling the wine with a magnetic motor driven oscillator (U.S. Pat. No. 6,332,706).

Although each of the aforementioned methods serve the purpose of aerating wine, at present there are not any such devices that provide the aeration process coupled with a filtering device where a consumer can serve themself without pouring from a container.

Beyond the added functionality of a self serving wine dispenser which filters and aerates wine, the invention also presents a certain aesthetic quality that enables the consumer to display and use the invention in nearly every social setting where wine is served. This is all done in absence of mechanical motors and drives, providing an ambiance missing from the mechanical apparatus.

SUMMARY OF INVENTION

The invention provides the consumer a means to aerate wine, trap particulates that may have formed in the bottle during fermentation or those introduced during the process of uncorking the a bottle of wine, and dispense wine into a suitable receptacle.

To use the invention, a valve is secured to the base of the decanter. The base of the decanter has an internal flange to which the valve is attached.

Once the valve is secured to the opening, the glass decanter is positioned on the structural support and secured in place. A fine stainless steel mesh filter is positioned at the mouth of the decanter and allowed to rest on the indention ring that secures the decanter to the structure. Once the filter is in place, the glass sphere is placed on the concave shape of the filter. Water inside the sphere provides the necessary weight to keep the sphere stationary while pouring wine over its surface.

With all components in place, wine is poured over the surface of the glass sphere. Capillary action between the glass surface and the wine draws the wine over the surface of the sphere releasing the wine where the filter comes into contact with the sphere. Wine then collects in the decanter for dispensing through the spring loaded valve.

Some wines require decanting prior to serving due to a large amount of sediment that has formed over time. Through decanting, sediment settles to the bottom of the bottle. Some of the sediment may be accidentally poured from the bottle as the bottle is emptied. The decanter is designed to allow those particles to be trapped in the section above the indention ring of the decanter, delineated by the filter. The decanter's wine capacity is such that a full bottle of wine fills the decanter above the indention ring and any sediment will be released into this section. Once wine is dispensed, the wine level recedes slowly as the consumer fills their glass, trapping particles on the upper glass surfaces as well as the filter.

In the event white wines are preferred, the glass sphere may be frozen to assist in the preservation of cooler wine temperatures. A previous patent was secured for this function in 1903 by August Glebsattel, (U.S. Pat. No. 740,847) although the intent was primarily for health purposes. The cooling is accomplished by 3 avenues. First, as wine passes over the surface of the sphere, the wine is cooled without diluting its contents with water. Second, once a full bottle is poured into the decanter, the level of the wine from a full bottle fully contacts the sphere and chills the wine. Third, once some of the wine is dispensed, the stainless steel filter can be removed and the sphere positioned on the indention ring. This provides a mechanical seal impeding the flow of air to the surface of the wine and provides cool air for the top half of the decanter.

DETAILED DESCRIPTION

Figure 3:
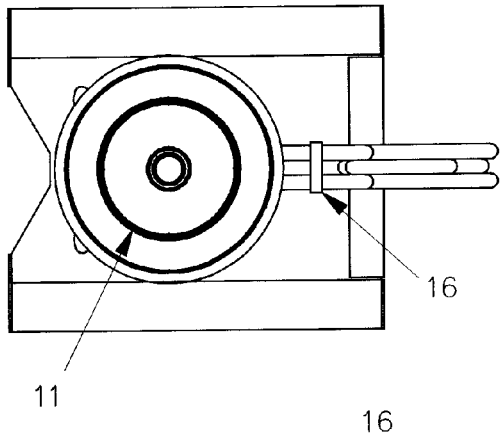
FIGS. 1-3 show the orthogonal views of the assembly.
Figure 2:
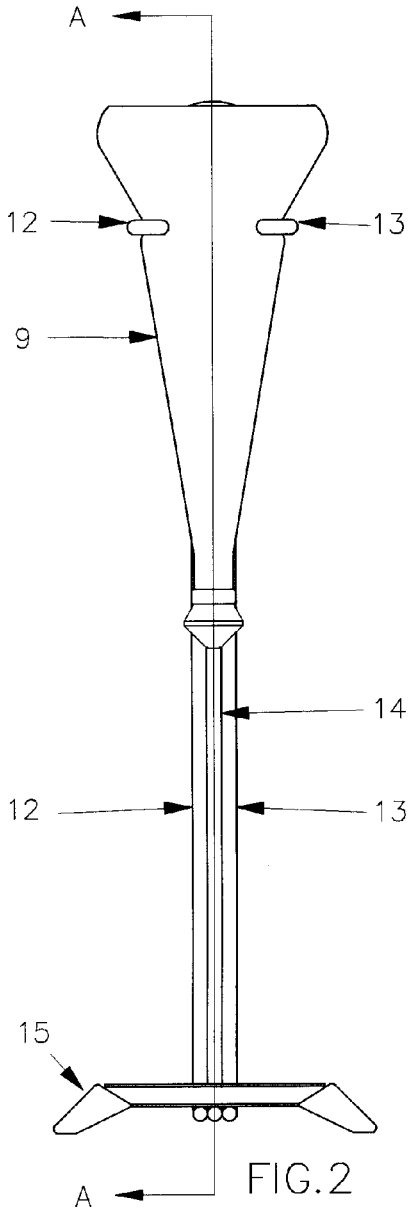
Figure 1:
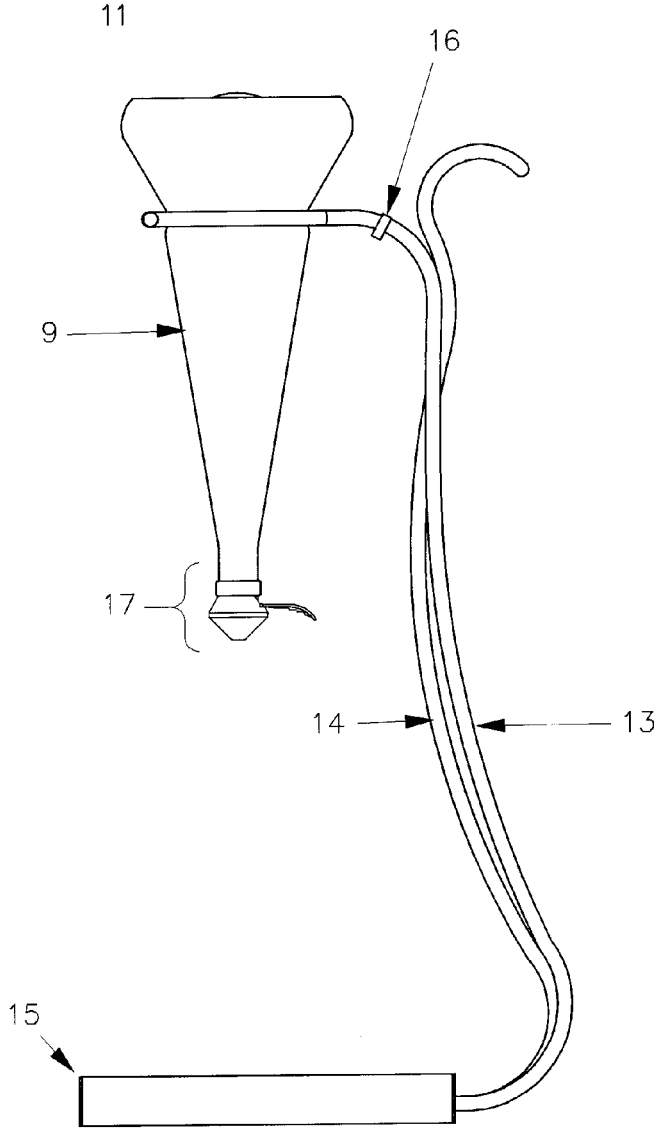
Figure 4:
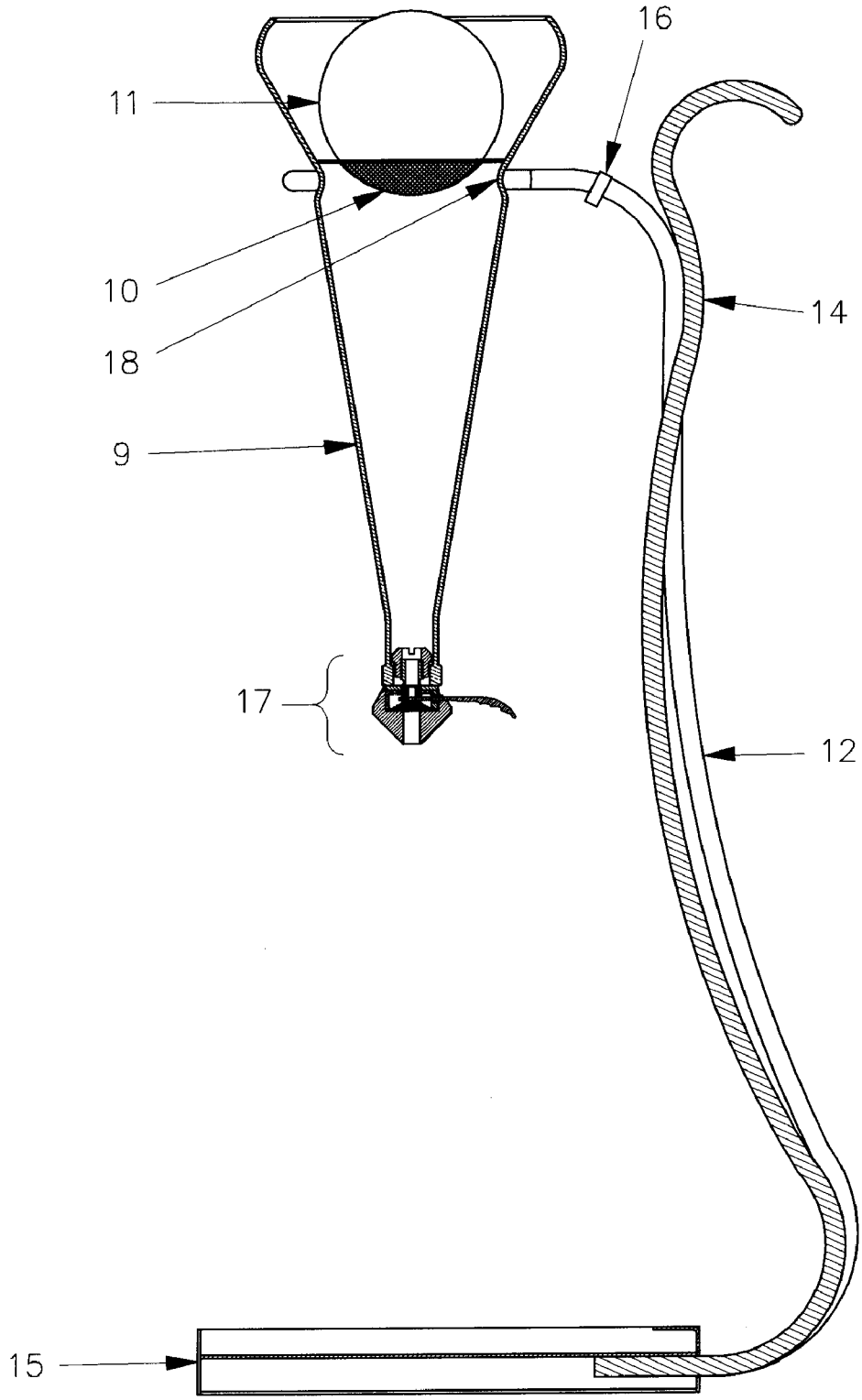
FIG. 4 is a cross section of the assembly showing the interior mechanisms.

The described invention provides an artistic mechanism to aerate, filter, chill and store wine for easy dispensing into a wine glass. The basic components of the invention are described as a decanter (9) which houses the nozzle (17), filter (10), and wine bubble (11). The decanter (9) is mechanically attached to the right (13) and left (12) hand support rods. These rods as well as the center decorative rod (14) are welded or otherwise attached to the base (15). A clip (16) bridges the right (13) and left (12) hand supports to squeeze the rods against the decanter (9) at the indention ring (18) (FIG. 4). This holds the decanter (9) firmly in the support structure. When the clip (16) is removed the decanter (9) can then be removed from the support structure for cleaning.

The valve (17) which dispenses wine is a spring (8) loaded devise which is activated by physically rotating the lever (6) upward in order to pivot the lever (6) away from the grommet (5). The valve chamber (4) maintains the relationship between the grommet (5) and lever (6). These items are held in place by the valve body (7) housing and pressed in place by the valve post (3). These items comprise the valve (17).

The valve (17) is mechanically attached to the decanter (9) with the valve nut (1). An O-ring (2) is positioned on the nut (1) prior to attaching it to the decanter (9) to prevent leaks. The O-ring (2) seals against an internal flange molded into the nose of the decanter (9). Since the nut (1) and post (3) are threaded, the valve (17) can be removed for maintenance.

Figure 5:
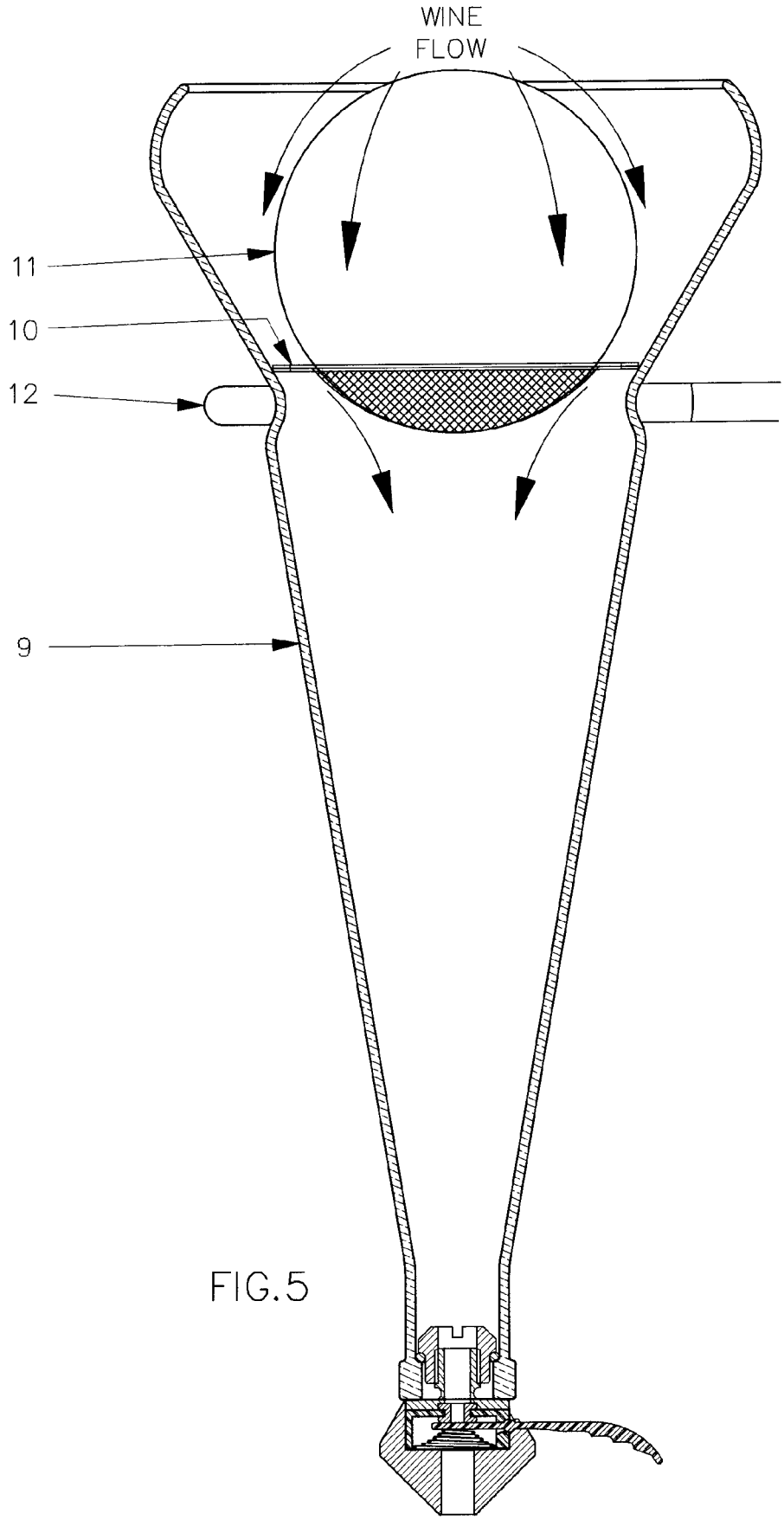
FIG. 5 shows the assembly detail of the decanter. It also illustrates the path the wine takes as it is poured into the decanter.
Figure 6:
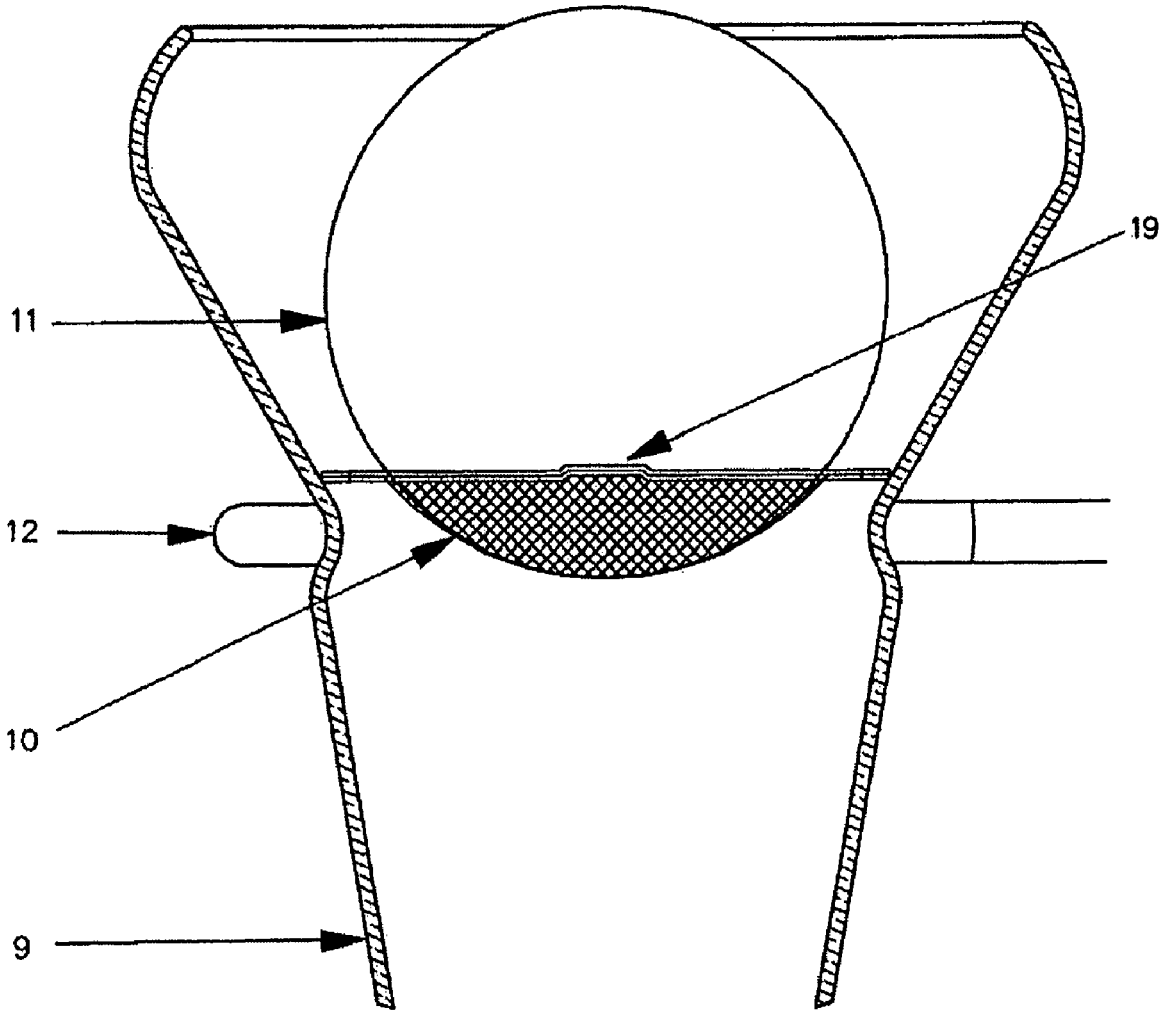
FIG. 6 shows the relief created in the filter to allow air to be displaced as wine enters the decanter.

FIG. 5 illustrates the flow of wine through the decanter (9). As wine is introduced to the decanter (9), it first makes contact with the wine bubble (11). The arrows show the directional flow of wine over the surface. As the wine travels down, it coats the wine bubble (11) which creates a thin film where air can readily mix with virtually every drop of wine. As the wine makes contact with the filter (10), a slight amount of turbulence is created which gently agitates the wine. At this juncture, sediment and unwanted items are removed from the pour. At times, the wine will coat the entire surface of the filter (10) creating a wine membrane over the surface. For this reason, air vents (19) (FIG. 6) are added to either side of the filter (10) to allow air to escape the decanter (9) as the air is displaced with wine.

In summary, the invention may be described as an open top glass vessel (9) for aerating, filtering and dispensing wine comprising a gravity fed container (9) to collect and store wine, a glass sphere (11) (containing a liquid medium) to introduce air to the wine as wine passes over the glass surface, a stainless steel mesh (10) to trap sediment and other debris normally introduced during the process of pouring wine from a bottle, and a valve (17) to activate the flow of wine from the vessel (9) to a drinking glass.

A support structure is provided to support the apparatus. This support structure may be artistic in nature and made of any suitable material to support the apparatus. The support structure includes the base (15), the left and right hand support rods (12, 13), as well as the decorative rod (14).

The filter (10) may be removed from the container (9) and the glass sphere (11) may be repositioned so as to seal the opening of the vessel (9) and protect the contents in the vessel (9) from foreign debris.

The glass sphere (11) may be frozen and repositioned at the opening of the vessel (9) to assist in cooling wine as wine passes over its surface.

Figure 7:
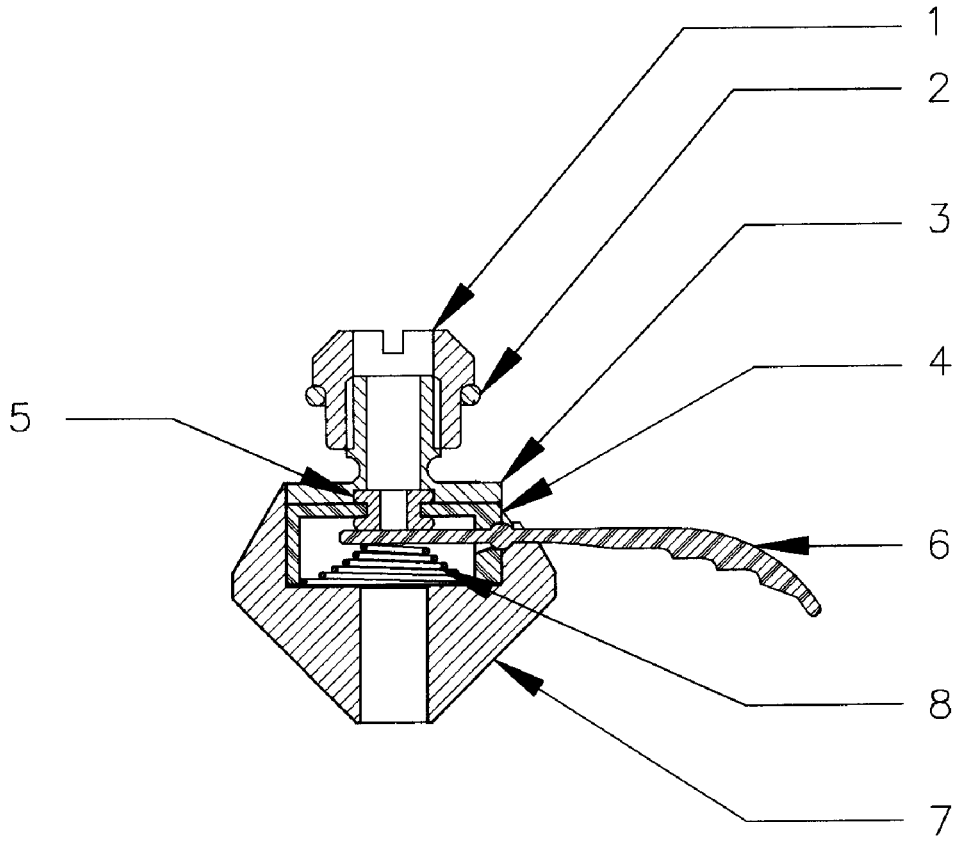
FIG. 7 shows the various components of the nozzle in the closed position, where
Figure 8:
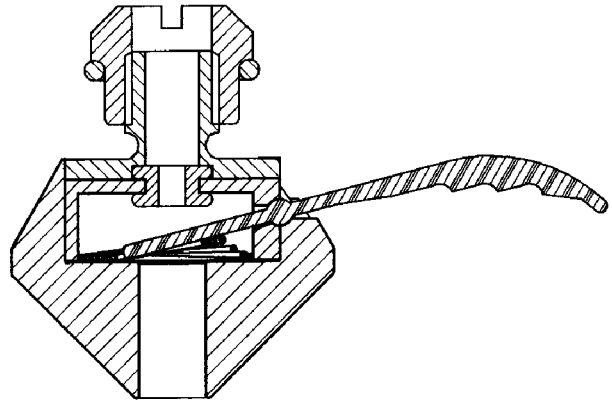
FIG. 8 shows the nozzle in the open position.

The valve (17) is spring loaded by spring (8) as seen in FIGS. 7 and 8, and as such prevents the flow of wine through the valve opening. The lever (6) that protrudes from the valve (17) allows the flow of wine once the lever (6) is pushed upwards by either the rim of a glass or by another manual means.

The invention claimed is:

1. A decanter apparatus, comprising:

a container having an open top end and a lower end;

a filter disposed in the container;

a glass sphere received in the container above the filter, so that a beverage may be poured into the open top end of the container to flow over the sphere to aerate the beverage, and through the filter to filter the beverage, and into a lower portion of the container below the filter; and a valve connected to the lower end of the container for dispensing the beverage from the container, the valve including an actuator for moving the valve between a closed position and an open position.

2. The apparatus of claim 1, wherein:

the container is made of glass and includes an indentation ring formed in the glass container; and the filter rests upon the indentation ring.

3. The apparatus of claim 2, wherein:

the container has a capacity such that a full bottle of wine fills the container above the indentation ring so that any sediment from wine poured into the container will be released into an upper portion of the container above the filter.

4. The apparatus of claim 1, wherein:

the filter comprises a concave shape; and the glass sphere is received in the concave shape of the filter.

5. The apparatus of claim 1, wherein:

the filter comprises a stainless steel mesh.

6. The apparatus of claim 1, wherein:

the glass sphere contains a liquid medium.

7. The apparatus of claim 6, wherein:

the liquid medium in the glass sphere is water.

8. The apparatus of claim 1, further comprising:

a support structure including a base and at least two support rods extending upward from the base, and a removable clip connecting the two support rods for squeezing the support rods against the container to hold the container firmly in the support structure.

9. The apparatus of claim 8, wherein:

the container includes an indentation ring between its top end and its lower end; and the two support rods engage the indentation ring of the container.

10. The apparatus of claim 1, wherein:

the valve comprises a valve body, and the actuator comprises a lever having an external portion extending out of the valve body and an internal portion extending into the valve body, and the valve further comprises a biasing spring biasing the internal portion of the lever upwardly toward a closed position, so that a user may press upward on the external portion of the lever to open the valve and dispense wine from the container.

11. The apparatus of claim 1, wherein:

the filter includes an air vent for allowing air to escape from the container.

12. A decanter apparatus, comprising:

a glass container having an upper end and a lower end, the upper end being open;

a filter received in the container between the upper end and the lower end, the filter engaging and resting on the container, the filter comprising a concave filter portion;

a wine bubble received in the concave filter portion; and a valve connected to the lower end of the container.

13. The apparatus of claim 12, wherein:

the container includes an internal flange at the lower end of the container;

and the valve includes an 0-ring seal between the valve and the internal flange of the container.

14. The apparatus of claim 13, wherein:

the valve comprises a valve body, a lever having an external portion extending out of the valve body and an internal portion extending into the valve body, and the valve further comprises a biasing spring biasing the internal portion of the lever upwardly toward a closed position, so that a user may press upward on the external portion of the lever to open the valve and dispense wine from the container.

15. The apparatus of claim 12, wherein:

the filter includes air vents for allowing air to escape from the container as the air is displaced with wine being poured into the container.

16. The apparatus of claim 12, wherein the filter comprises a stainless steel mesh.

17. The apparatus of claim 12, wherein the wine bubble comprises a glass sphere.

18. The apparatus of claim 12, wherein the wine bubble contains a liquid medium.

19. The apparatus of claim 18, wherein the liquid medium comprises water.

* * * * *